US008832986B2

(12) United States Patent
Mayberry et al.

(10) Patent No.: US 8,832,986 B2
(45) Date of Patent: Sep. 16, 2014

(54) QUICK DETACH SLING SWIVEL

(71) Applicants: Michael T. Mayberry, Denver, CO (US); Richard M. Fitzpatrick, Longmont, CO (US)

(72) Inventors: Michael T. Mayberry, Denver, CO (US); Richard M. Fitzpatrick, Longmont, CO (US)

(73) Assignee: Magpul Industries Corp., Erie, CO (US)

( * ) Notice: Subject to any disclaimer, the term of this patent is extended or adjusted under 35 U.S.C. 154(b) by 0 days.

(21) Appl. No.: 13/896,017

(22) Filed: May 16, 2013

(65) Prior Publication Data

US 2013/0305582 A1 Nov. 21, 2013

Related U.S. Application Data

(60) Provisional application No. 61/647,894, filed on May 16, 2012.

(51) Int. Cl.
*F41C 23/02* (2006.01)
*F41C 33/00* (2006.01)

(52) U.S. Cl.
CPC ..... *F41C 33/006* (2013.01); *F41C 23/02* (2013.01)
USPC ..... 42/85; 24/2.5; 224/150

(58) Field of Classification Search
CPC ..... F41C 23/02; F41C 33/006
USPC ..... 42/85; 224/150; 24/2.5, 573.11
See application file for complete search history.

(56) References Cited

U.S. PATENT DOCUMENTS

| | | | |
|---|---|---|---|
| 2,480,662 | A | 8/1949 | McKinzie |
| 2,642,689 | A | 6/1953 | Clline |
| 2,679,707 | A | 6/1954 | Merlino |
| 2,771,699 | A | 11/1956 | Herter |
| 3,061,965 | A | 11/1962 | Lewis |
| 3,066,375 | A | 12/1962 | Knowles et al. |
| 3,226,872 | A | 1/1966 | Pachmayr |
| 5,615,462 | A | 4/1997 | Goto |
| 5,845,377 | A | 12/1998 | Bibeault |

OTHER PUBLICATIONS

Command Amis Heavy Duty Push Button Sling Swivel, http://www.google.com/products/catalog?hl=en&sugexp=frgbld&gs_nf=1&qe=c2xpbmcgc3c&qesig=HX9, Retrieved Mar. 29, 2012.

Blackhawk 71SS00BK BH Hard Push Button Sling Swivel, http://www.google.com/products/catalog?hl=en&sugexp=frgbld&gs_nf=1&qe=c2xpbmcgc3c&qesig=HX9, Retrieved Mar. 29, 2012.

*Primary Examiner* — Reginald Tillman, Jr.

(74) *Attorney, Agent, or Firm* — Geoffrey Dobbin; Dobbin IP Law P.C.

(57) ABSTRACT

The present invention is a quick detach swivel utilizing pawls to engage a ridge or trench in a socket. The pawls are biased outward by the spurs of two sliding buttons which cam the pawls in an upright and outward orientation. When the buttons are squeezed together, the cam lock is released and the pawls fall into the swivel frame, releasing the swivel body. When pressure on the buttons is released, the buttons return to their normal positions and catch the pawls, returning them to their upright and engaged position.

2 Claims, 8 Drawing Sheets

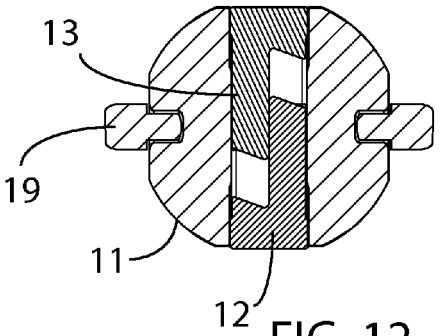
FIG. 12
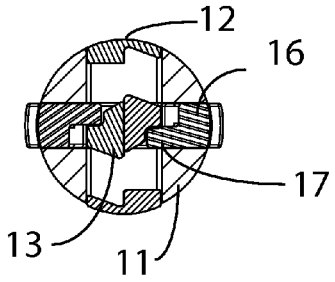
FIG. 13
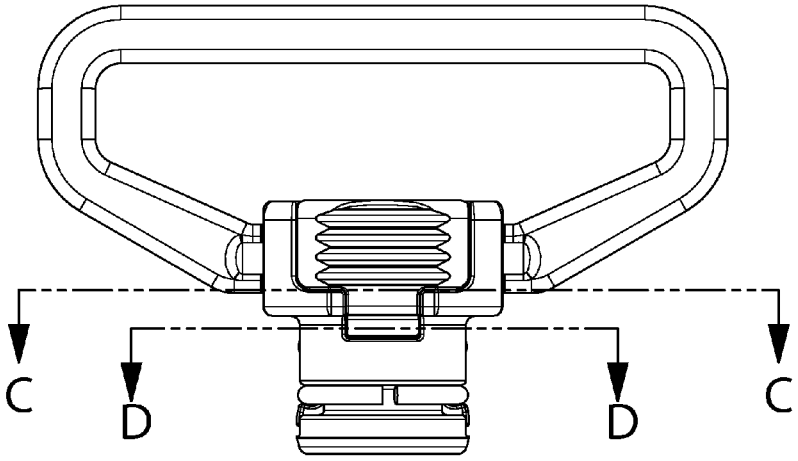
FIG. 14
FIG. 15
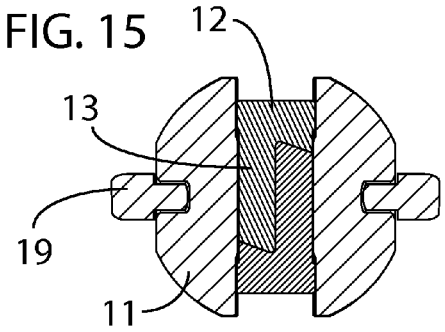
FIG. 16
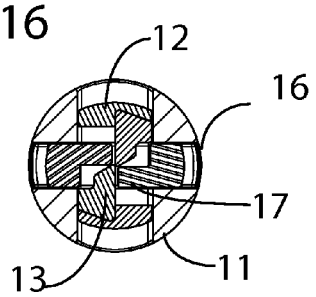

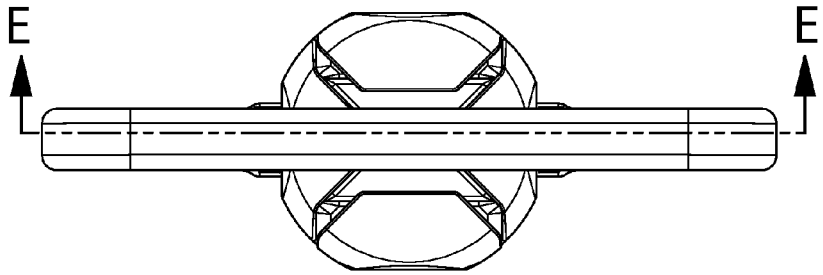
FIG. 17
FIG. 18
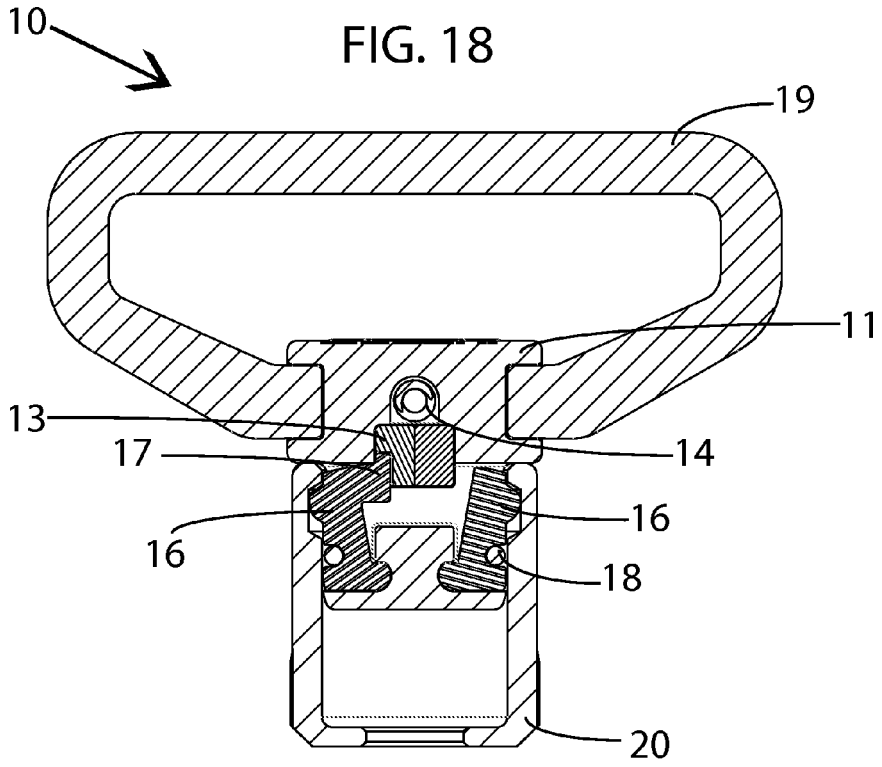

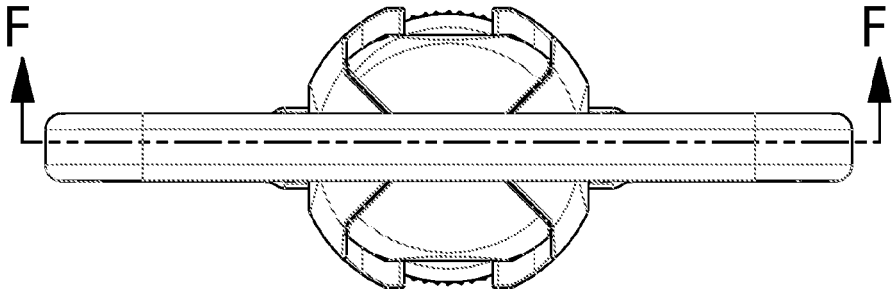
FIG. 19
FIG. 20
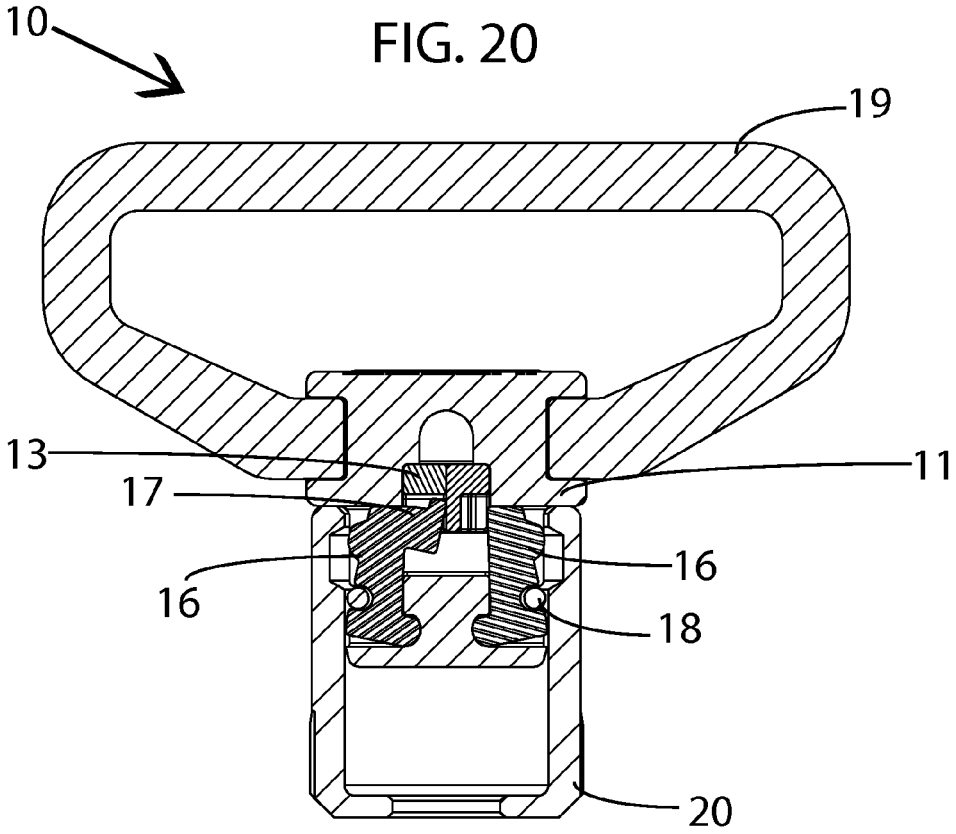

QUICK DETACH SLING SWIVEL

CROSS-REFERENCES TO RELATED APPLIATIONS

This Application claims priority as a non-provisional perfection of U.S. Provisional Application Ser. No. 61/647,894, filed May 16, 2012 and incorporates the same by reference in its entirety herein.

FIELD OF THE INVENTION

The present invention relates to the field of firearms and more particularly relates to a quick detach sling swivel for firearms and other similar devices.

BACKGROUND OF THE INVENTION

Since the invention of the long firearm, there has been a need to safely and effectively carry, handle and manipulate the weapon. One solution to the problem is the use of a sling. Slings are connected to firearms, and other devices, in many ways, but one of the most common is the use of a sling swivel. The sling swivel, as the name suggests, allows the sling to pivot, or swivel, in relation to the object being carried. This allows for greater freedom of movement on the part of the user. However, despite many advances in sling technology, slings can sometimes encumber or entangle the user more than it can help. For this reason, many sling swivels have been developed with a quick detach feature. In most cases, the quick detach feature of a sling swivel is an internal spring loaded plunger that biases a plurality of ball bearings through the swivel casing. The ball bearings then interface with a ridge in a swivel socket and hold the swivel in place. When desired, the user simply depresses the plunger and the bias on the ball bearings is removed, allowing them to roll into the casing and thereby allowing the swivel to be removed from the socket.

The current designs of the prior art do have one disadvantage. The action used to release the ball bearings directly opposes the action to remove the swivel from the socket. While this does help prevent accidental removal, it is counter-intuitive and somewhat awkward.

The present invention represents a departure from the prior art in that the quick detach swivel of the present invention utilizes a motion orthogonal to the action of removal. Being in a different direction than the action of removal, action of release still provides limitation to accidental removal; however that action is not counter to the action of removal and eliminates the inefficiency the counter actions provide in the prior art.

SUMMARY OF THE INVENTION

In view of the foregoing disadvantages inherent in the known types of sling swivels, this invention provides a quick detach sling swivel with a pinch release. As such, the present invention's general purpose is to provide a new and improved quick detach sling swivel that is easy and intuitive to use and efficient to manufacture.

To accomplish these objectives, the quick detach sling swivel comprises a swivel frame and a pair of opposed slidable buttons and a pair of opposed pivoting pawls. The swivel interfaces with a socket that has an internal ridge for which the swivel to interact. The two opposing top slide buttons are pinched together to release the swivel. The buttons are spring-biased and feature distal cam structures that hold the two pawls in position to interface with the ridge. When squeezed together, the slide buttons release the cam lock on the pawls and the pawls then disengage the ridge.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIG. 12 is a sectional view of the swivel body of FIG. 11, taken along line A-A.

FIG. 13 is a sectional view of the swivel body of FIG. 11, taken along line B-B.

FIG. 14 is a front elevation of the swivel body of FIG. 7, in a disengaged configuration.

FIG. 15 is a sectional view of the swivel body of FIG. 14, taken along line C-C.

FIG. 16 is a sectional view of the swivel body of FIG. 14, taken along line D-D.

FIG. 17 is a top plan view of the swivel body of FIG. 1, in an engaged configuration.

FIG. 18 is a sectional view of the swivel assembly of FIG. 17, taken along line E-E.

FIG. 19 is a top plan view of the swivel body of FIG. 1, in a disengaged configuration.

FIG. 20 is a sectional view of the swivel assembly of FIG. 19, taken along line F-F.

DETAILED DESCRIPTION OF THE PREFERRED EMBODIMENT

With reference now to the drawings, the preferred embodiment of the quick detach swivel is herein described. It should be noted that the articles "a", "an", and "the", as used in this specification, include plural referents unless the content clearly dictates otherwise.

With reference to FIGS. 1-5, the sling swivel 10 fits inside a swivel socket 20. Swivel socket 20 is known in the prior art and embedded into a firearm, usually a stock or other non-mechanical component, so that swivel body 10 may connect therein. Texturing on the exterior of the swivel socket 20 helps maintain the swivel socket 20 in the stock. Swivel 10 is connected to the sling itself, usually by threading the sling through bail 19, though other sling attachment means are possible.

Figure 1:
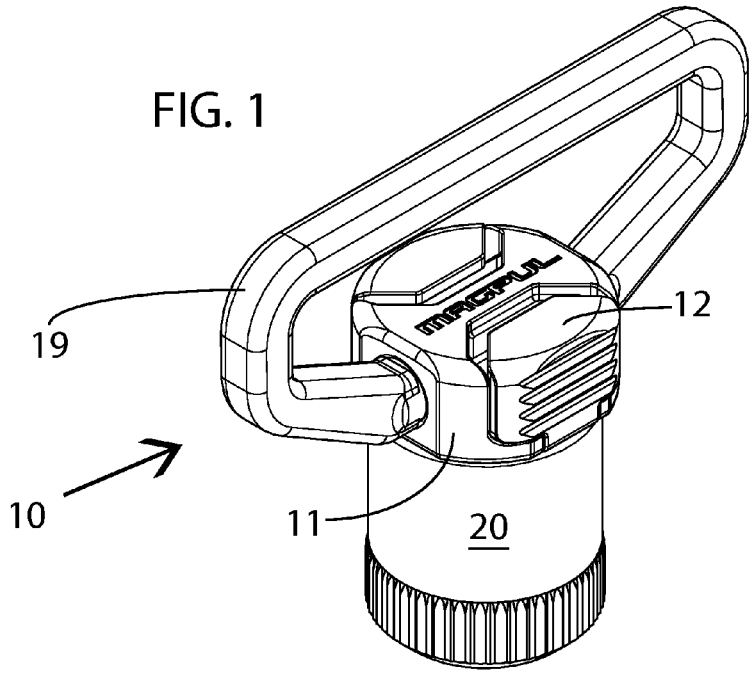
FIG. 1 is a perspective view of a preferred embodiment of the quick detach swivel assembly.
Figure 2:
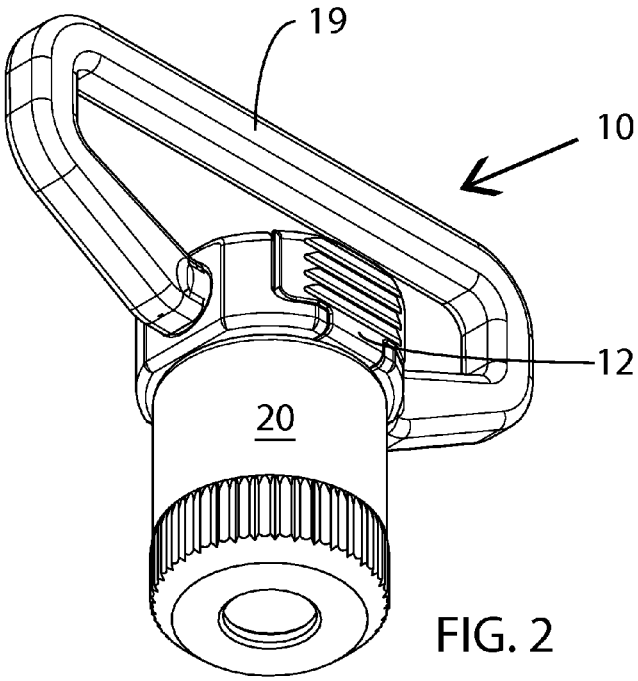
FIG. 2 is an alternate perspective view of the swivel assembly of FIG. 1.
Figure 3:
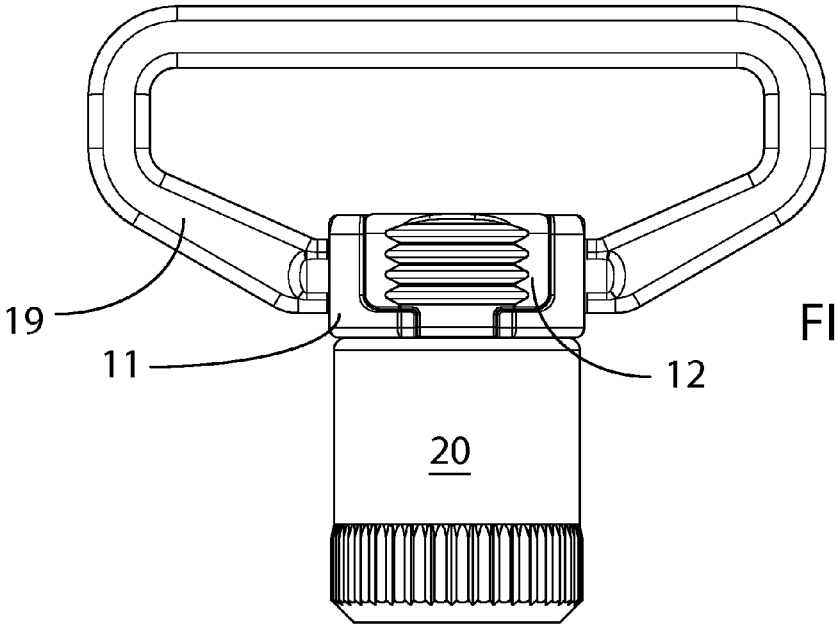
FIG. 3 is a front elevation of the swivel assembly of FIG. 1
Figure 4:
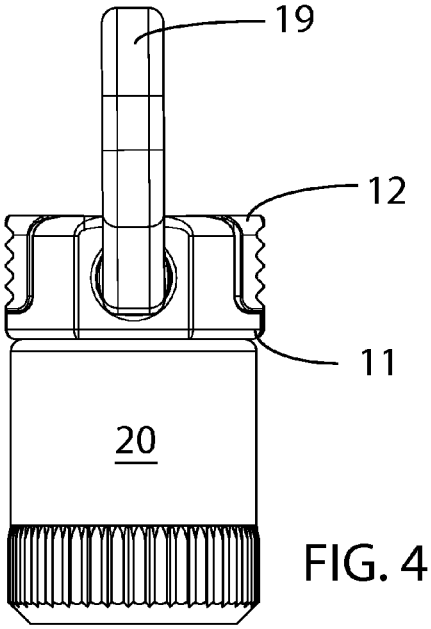
FIG. 4 is a side elevation of the swivel assembly of FIG. 1.
Figure 5:
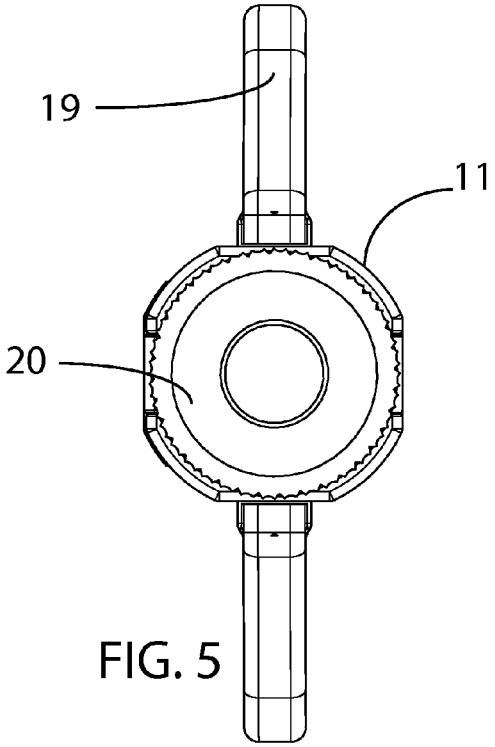
FIG. 5 is a bottom plan view of the swivel assembly of FIG. 1.
Figure 6:
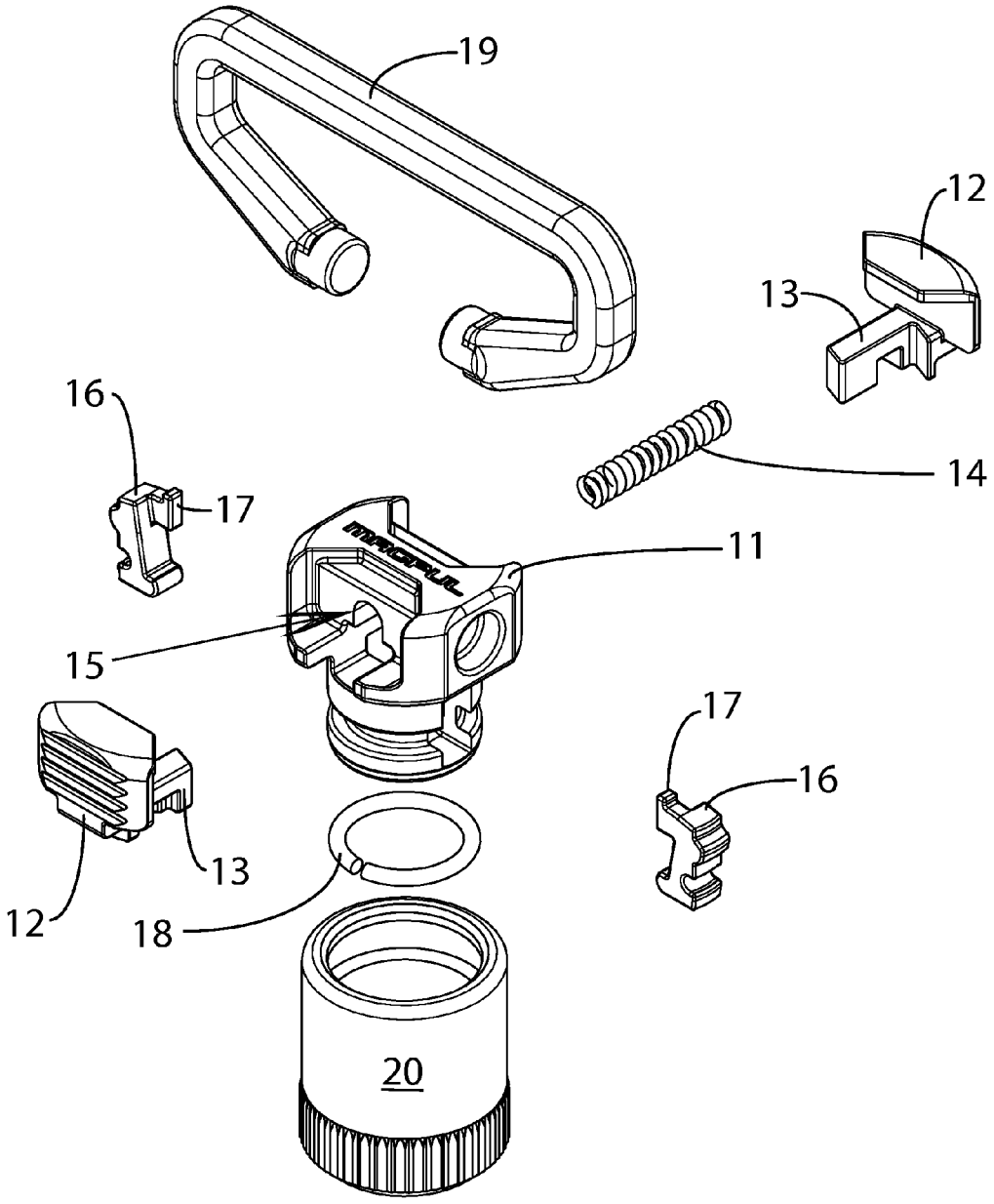
FIG. 6 is an exploded view of the swivel assembly of FIG. 1.
Figure 7:
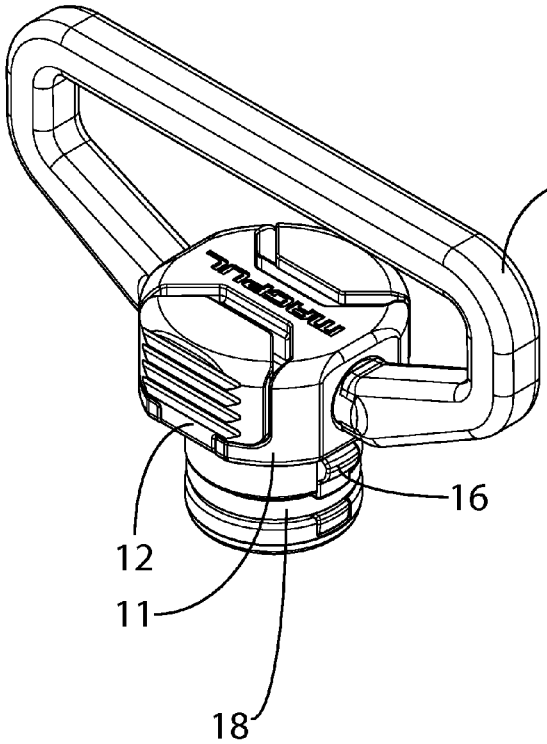
FIG. 7 is a perspective view of the swivel body utilized in the swivel assembly of FIG. 1.
Figure 8:
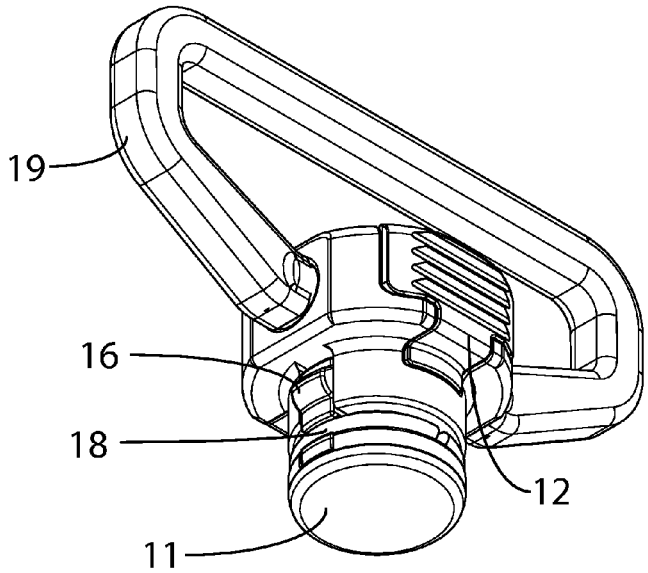
FIG. 8 is an alternate perspective view of the swivel body of FIG. 7.
Figure 9:
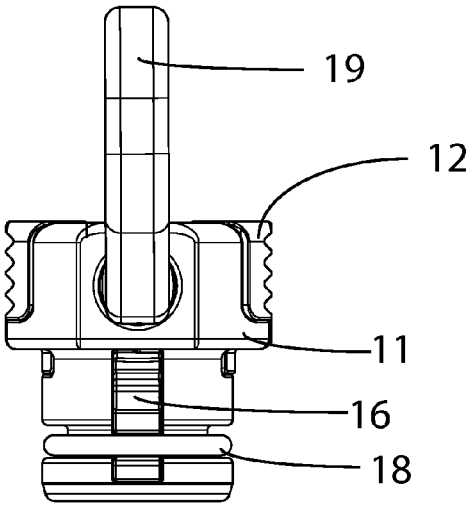
FIG. 9 is a side elevation of the swivel body of FIG. 7
Figure 10:
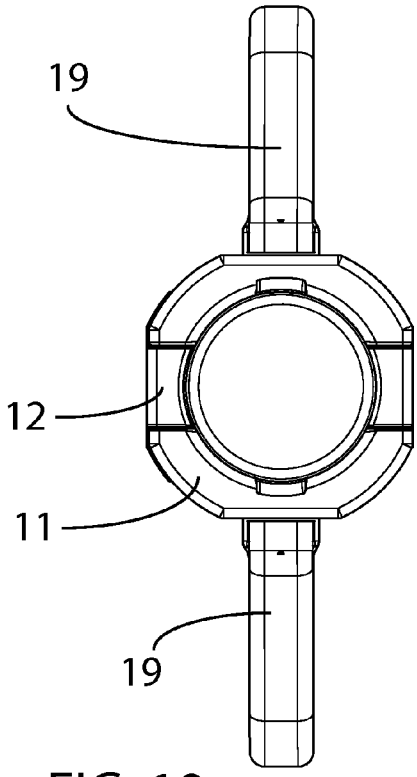
FIG. 10 is a bottom plan view of the swivel body of FIG. 7
Figure 11:
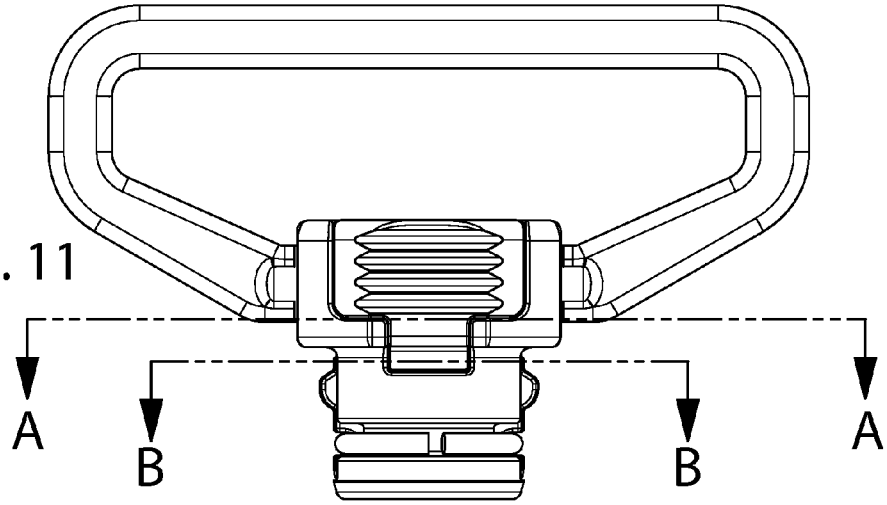
FIG. 11 is a front elevation of the swivel body of FIG. 7, in an engaged configuration.

As seen in FIG. 6, the swivel 10 comprises a swivel frame 11 having a central passage 15. The passage 15 extends across an upper portion of the swivel frame 11, ending in two openings, and also downwards and across a lower portion of the swivel frame 11 such that it ends in two open slots that are orthogonally related to the openings in the upper portion of the passage 15.

As seen in FIGS. 6-11, two slidable buttons 12 reside in the upper portion of passage 15. The slidable buttons are counter-biased against each other by a spring 14 through passage 15 in the swivel frame 11. Each button 12 has a spur 13 extending into the passage 15. Two pawls 16 reside in the lower portion of the swivel frame 11, projecting in directions perpendicular to the sliding buttons 12. Each pawl 16 has an upper projection 17 that extends into the passage 15 and each pawl 16 is secured in position by a retaining ring 18 about a lower end of the swivel frame 11 and pawls 16.

In use, shown in FIGS. 11-20, the two sliding buttons 12 naturally reside about a perimeter of the swivel frame 11 and their spurs 13 extend into the swivel frame 11 through the passage 15 (FIG. 12). These spurs 13 project downward at their terminal ends and interface with and nests the upper projection 17 of each pawl 16 (FIG. 13). To release the swivel, the two sliding buttons 12 are squeezed together, moving the spurs 13 away from the upper projections 17 (FIGS. 15 and 16) and allowing the pawls 16 to fall into the swivel frame 11. Pawls 16 may be leveraged to fall inward into the swivel frame 11 or may rely on the fact the pawls are no longer biased outward as the swivel is removed in order to disengage the pawls 16 from the swivel socket 20. When pressure on the sliding buttons 12 is released, a wedge on the spurs 13 moves the pawls 16 outwards again, and nests the upper projection 17 back inside the spurs 13.

When inside the swivel socket 20, the swivel 10 connects by the interface of the pawls 16 with a trench or ridge inside the socket 20 (FIGS. 17-20). When engaged, the pawls 16 have teeth that are forced outwards and into the trench/against the ridge (FIGS. 17 and 18). When the pawls 16 have fallen into the swivel frame 11 (FIGS. 19 and 20), the teeth disengage and the swivel body 10 may be removed from the swivel socket 20.

The swivel may be constructed of any suitable material, including but not limited to metal, polymer and composite materials and combinations thereof. The latching mechanism may also be readily adapted to other fields and such adaptations should be seen as equivalent constructions and inherently included in this invention.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A sling swivel comprising:

a swivel housing;

a pair of hinged pawls, diametrically opposed to each other and hinged at a bottom of the swivel housing, each having a projection that projects from an upper part of each hinged pawl into the swivel housing;

a pair of sliding buttons, diametrically opposed to and spring-biased against each other while residing above and orthogonally oriented with respect to the hinged pawls, each button having a spur that extends downward in a manner to engage the projections and cam the pawls outward;

wherein, once the buttons are forced against their spring bias, the spurs disengage from the projections and allow the pawls to fall inward of the swivel housing and, when such force is removed, the spring bias forces the buttons outward from each other and the spurs re-engage the projections, forcing the pawls outward.

2. A latching mechanism comprising a housing;

a pair of hinged pawls, diametrically opposed to each other and hinged at a bottom of the housing, each having a projection that projects from an upper part of each hinged pawl into the housing;

a pair of sliding buttons, diametrically opposed to and spring-biased against each other while residing above and orthogonally oriented with respect to the hinged pawls, each button having a spur that extends downward in a manner to engage the projections and cam the pawls outward;

wherein, once the buttons are forced against their spring bias, the spurs disengage from the projections and allow the pawls to fall inward of the housing and, when such force is removed, the spring bias forces the buttons outward from each other and the spurs re-engage the projections, forcing the pawls outward.

* * * * *